United States Patent [19]

Graf et al.

[11] 3,969,456

[45] July 13, 1976

[54] METHOD FOR MAKING C-SHAPED MAGNETIZABLE CORE

[75] Inventors: Richard B. Graf; Edward H. Chant, Jr., both of Marengo; John F. Marco, Woodstock, all of Ill.

[73] Assignee: Arnold Engineering Company, Marengo, Ill.

[22] Filed: Feb. 22, 1971

[21] Appl. No.: 117,809

Related U.S. Application Data

[62] Division of Ser. No. 820,815, May 1, 1969, Pat. No. 3,566,323.

[52] U.S. Cl. ..... 264/111

[51] Int. Cl.[2] ..... B22F 5/00

[58] Field of Search ..... 264/109, 111

[56] References Cited

UNITED STATES PATENTS

| | | | |
|---|---|---|---|
| 2,357,407 | 9/1944 | Kurtz | 264/111 |
| 2,365,720 | 12/1944 | Neighbors | 264/111 |
| 2,825,095 | 3/1958 | Heck | 264/111 |

FOREIGN PATENTS OR APPLICATIONS

| | | | |
|---|---|---|---|
| 571,473 | 8/1945 | United Kingdom | 264/111 |

*Primary Examiner*—Robert F. White
*Assistant Examiner*—J. R. Hall
*Attorney, Agent, or Firm*—Vincent G. Gioia

[57] ABSTRACT

A method for making a C-shaped magnetizable core powdered material manufactured by filling a predetermined quantity of the powdered material into a C-shaped mold having two open ends one end being smaller than the other open end and having a trapezoidal cross section, compressing said powdered material to a density of at least 6.0 g/cm$^3$ by a cooperating, C-shaped ram and a combined C-shaped closure-ejector element; the C-shaped ram entering the larger opening and moving toward the smaller opening which is closed by said closure-ejector element, withdrawing the ram and ejecting the core from the die with said closure-ejector element moving from the smaller opening toward the larger opening whereby the trapezoidal sides of the core are released simultaneously whereby the core uniformly expands in all directions as it is ejected from the die to produce a core having a uniform density and of improved structural, magnetic and electrical properties.

4 Claims, 7 Drawing Figures

METHOD FOR MAKING C-SHAPED MAGNETIZABLE CORE

This application is a division of copending application Ser. No. 820,815 filed May 1, 1969, now U.S. Pat. No. 3,566,323, filed Feb. 23, 1971.

BACKGROUND OF THE INVENTION

The utilization of high permeability material such as powdered molybdenum iron-nickel alloy in the cores of loading coils has been long known in the communications industry. Such materials are conventionally compressed at extremely high pressures such as 100 to 150 tons per square inch, subsequently annealed to improve magnetic and structural properties, and, finally, insulated as by a baked varnish coating. One piece cores have been made in full toroids, however, that shape presents several disadvantages in the industry. By virtue of its single surface closed construction, the toroidal core requires any- coil being placed around the core to be wound directly about the shape. Thus, any insulation required between the winding and the core material must be either placed on the winding or coated directly on the toroid which further necessitates special handling of the winding and the core insulation. Additionally, there are limitations to the winding of a coil around the toroidal core in that automatic winding on such a shape is difficult, and in the cases of a heavy conductor, is impossible thereby necessitating hand winding. In order to circumvent these manufacturing problems, cores have been made in L shapes with two of these shapes subsequently assembled to form toroid cores. It has been necessary in the past in making sectional cores to employ a molding die made up of a plurality of removable die sections in order to permit withdrawal of the formed L from the die cavity. The die sections forming the L-shaped cavity conventionally are individually clamped on a suitable platform in an abutting sort of relationship and after the required pressure has been applied to a charge of powdered material within the cavity the die sections are unclamped from the platform and moved away from the formed body to permit removal of the compressed core. Both the core section shape and the method of making that shape present serious disadvantages which are overcome by the shape and method of manufacture of this invention. For example, the necessity of repetitive clamping and unclamping of the plurality of die sections in the forming operation for L shapes results in rapid deterioration of the die sections which results in varying core shapes. Further, the occurrence of gaps between the die sections upon reassembly for another molding contributes to further non-uniformity of the shape of the product formed therein. The inherent mobility of assembled die sections contributes to non-rigidity of the die cavity allows non-uniform compression of the charge of powdered material within the cavity under the high compressing pressures. Non-uniform compression results in a non-uniform density of material, an irregular shape, as well as internal stresses within the material, all of which contribute to the disadvantages of the process. Additionally, the necessity of unclamping assembling and disassembling and clamping the die sections to remove the formed core and to prepare for another operation does not lend to any sort of automated manufacturing operation.

SUMMARY OF THE INVENTION

The present invention generally provides a method for forming a C-shaped core with a trapezoidal cross section of compressed powdered material by uniformly subjecting the powdered material contained in a die cavity to a uniform high pressure and of uniformly releasing the pressure following the compression and of removing the formed section of compressed powdered material from the pressure cavity in such a manner to avoid flexure or deformation of the body during the removal step. In particular the present invention includes a method for forming C-shaped sections of cores in an automatic operation having a cavity surrounded by a utilized die structure symmetric about one central axis. The cores produced by the method of the present invention are of more uniform density, permeability and physical dimension and possess improved magnetic, electrical and structural characteristics. Additionally, the C-shaped core with trapezoidal cross section made by the process of this invention exhibits more uniform magnetic and electrical characteristics when used in a toroidal combination with another similarly shaped core, than cores made by prior art methods. These cores are capable of receiving machine wound coils of conductors of no special size limitations, wound on a core form and insertable over the legs of the sections as they are assembled. Further, in assembled relation the juncture between abutting sections falls within the tolerable space limits of a given core winding, thus minimizing any non-uniformity of magnetic field distribution which might exist in that juncture. These and other features of the present invention will appear more fully from the following detailed description and drawings which accompany the specification.

DESCRIPTION OF THE PREFERRED EMBODIMENT

Figure 1:
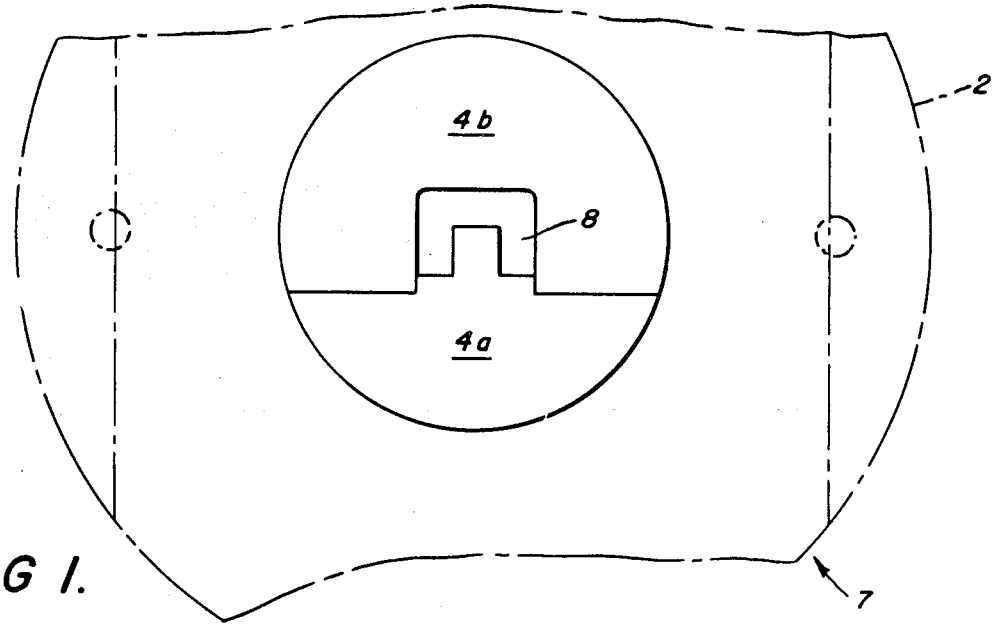
FIG. 1 is a partial plan view showing die construction for making C cores.

Referring now to the drawings reference numeral 2 indicates a die sleeve having die inserts 4(*a*) and 4(*b*) of a hard material such as a carbide and a table 6 upon which inserts 4 and 4(*b*) are seated, all of which form unitized die structure 7. Die inserts 4(*a*) and 4(*b*) form a C-shaped die cavity 8 having a top opening 10 and bottom opening 12. Tapered walls 13 give the cavity 8 a trapezoidal cross section with walls 13 being the non-parallel sides. Table insert 6 has an opening 14 to receive an ejector 16 having a C-shaped portion 18 adapted to cooperate with opening 12. In the example disclosed inserts 4(*a*) and 4(*b*) and table 6 are retained in sleeve 2 by a shrink fit of the sleeve about the inserts. The sleeve 2 is adapted to be received into automatic stamping equipment, not shown but well known in the industry, in which ejector 16 operates at appropriate intervals and in which also is mounted actuating means for compressing a tapered punch 20 having a C-shaped portion 22 adapted to cooperate with opening 10 for compressing material placed in the cavity 8 of the die. In the preferred arrangement table 6 meets die molding insert 4 forming a shoulder 24 in the vicinity of opening 12. With such an arrangement ejector 16's outer perimeter describes an envelope smaller than die opening 8. It is to be noted, however, that shoulder 24 and ejector 16 in the retracted position as shown by the dotted line of FIG. 2 form the bottom of cavity 8, against which the compression of ram 20 is opposed through the powered material deposited in the cavity.

Figure 2:
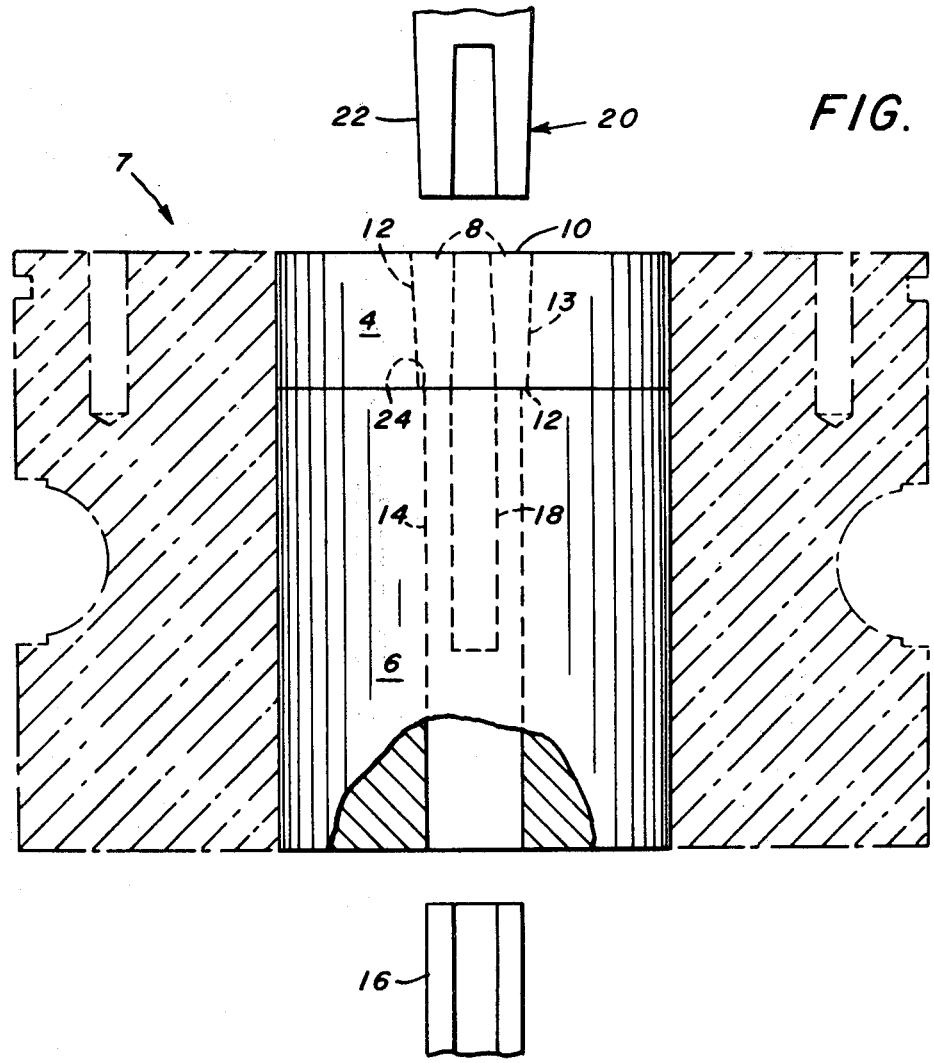
FIG. 2 is an elevational view partially in section illustrating the apparatus for performing the invention.
Figure 5:
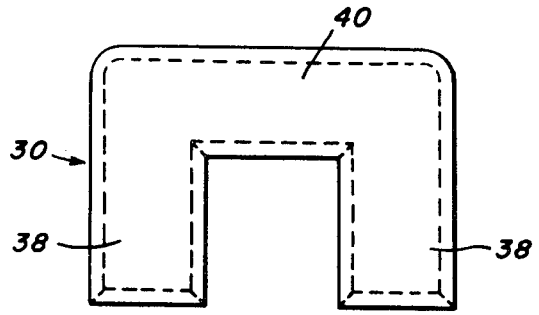
FIG. 5 is a plan view of the C core shown in FIGS. 3 and 4 made by process of the invention.
Figure 3:
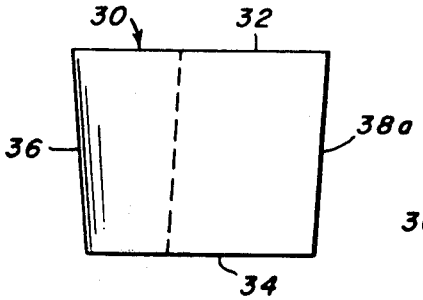
FIG. 3 is a side elevation of a C core made by the process of the invention inverted from its formation position in the die cavity of FIGS. 1 and 2.
Figure 4:
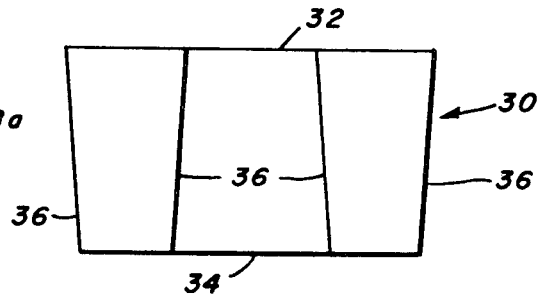
FIG. 4 is a front elevation of the C core as shown in FIG. 3 of the invention.

To manufacture C-shaped magnetizable cores the die structure shown in FIG. 1 and 2 may be installed in the stations provided in automatic pressing machines for compressing insulated powdered material as is well known in the industry. Such machines perform various mechanical functions not a part of this invention, such as introducing the measured quantity of powdered metal into the die cavity, initiating the actuating mechanism to compress the material into an integral core and further initiating the ejecting action to remove the core from the molding die. The specific sleeve 2, punch 20 and ejector 16 may be adapted to be received in the appropriate operational sections of such automatic machinery. The commencement of the manufacturing operation occurs with lubrication of the die mold walls 13, as by an atomized lubricant followed by the introduction of a measured quantity of powdered material into the cavity 8. Following this the automatic machinery initiates the downward thrust of the punch 20 so that the C-shaped portion 22 enters the die mold cavity 8 at opening 10 contacting the powdered material. The area and shape of the C-shaped compressing face 23 of punch 20 is slightly less than opening 10, however, it closely approaches that of cavity 8 at the maximum downward position of punch 20 during its stroke cycle. This effect is due to the taper of the side walls 13, which in the disclosed embodiment is 1° from the vertical. As the two areas, i.e., the cross sectional area of the punch face and the cross sectional area of the die cavity approach equality at the final movements of the punch, there is provided a uniform compacting action within the cavity such that the material throughout the cross section of the core is uniformly compacted as the punch reaches its maximum compressive position. Also, since the walls 13 of the cavity 8 are only slightly tapered and since the corners formed by the meeting of punch 20 and the walls 13 in the base formed by shoulder 24 and the ejector 16 are substantially squared, a uniform compression exists throughout the cross section at the instant of maximum compression.

Upon completion of the compression stroke, punch 20 is removed from opening 8 thus clearing the way for the ejection of the core 30 from the die cavity 8. The ejection is initiated by ejector 16 being moved by the automatic equipment as stated in an upward direction. Due to the trapezoidal cross section in all aspects of the C-shaped mold discussed above, as core C is raised in the cavity 8, its die walls 36 clear the side walls 13 of the mold at a uniform rate. Thus the core 30 expands uniformly in all directions and the ability of the core 30 to expand equally in all directions as it is ejected from the mold minimizes any stresses or non-uniformities in density that might be developed within the core if it were otherwise ejected from the mold, i.e. by progressive forcing of the core from the die.

In the example disclosed, a core of insulated powdered material is produced having a uniform high permeability throughout. The uniformity of permeability is achieved through the uniform compression and absence of additional stresses in the form due to fluctuations in the die. High pressures may be used to achieve the higher permeabilities to compress the core because of the core and die geometry. Cores exhibiting permeabilities of 100 to 350 may be pressed under pressures of 80 to 150 tons/square inch in the shape and die of the invention. Cores thus pressed from insulated powdered metal such as the nickel-iron alloys having at least 30% nickel, commonly known as the permalloys, exhibit a uniform density of about 7.0 to 8.75 g/cm$^3$. Such cores of insulated powder may be produced of base alloys including up to 90% nickel in the base alloy and may also include additions of one or more of copper, cobalt, chromium, molybdenum and silicon as is well known in the art. Further, cores of a powder alloy containing at least 80% iron, 8% silicon and 4% aluminum have been pressed in C-shapes of uniform density of about 6.0 at pressures of about 100 tons and having a permeability of about 200. Uniform compression equalizes the distribution of forces throughout the core thereby minimizing the development of local stresses within the core structure, which minimizes deterioration of the magnetic and electrical properties of the core.

Figure 6:
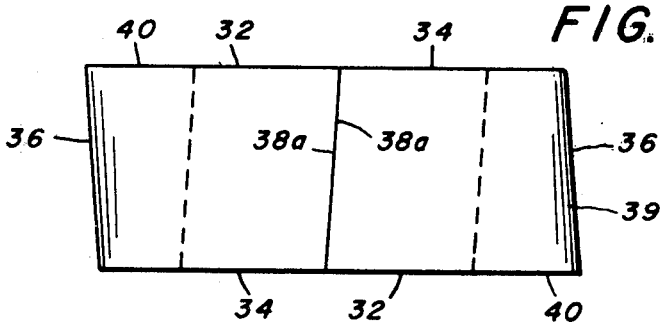
FIG. 6 is an elevation of a toroid formed of C cores made by process of the invention.
Figure 7:
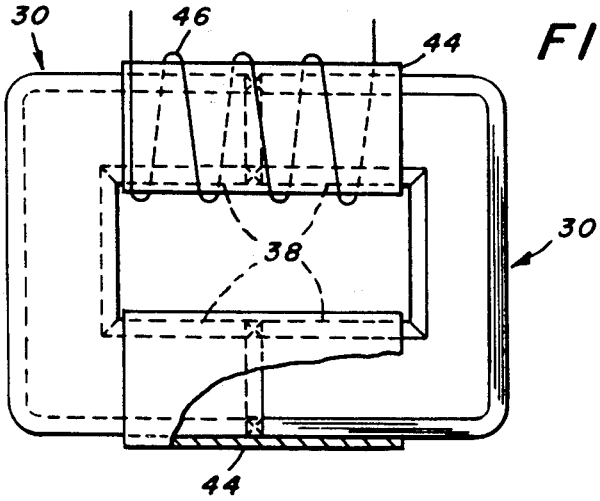
FIG. 7 is a plan view of a toroid formed of C cores of the invention one being inverted for assembly with the other section including windings.

FIGS. 6 and 7 illustrate the use of two C-shaped cores 30 in a coil application wherein legs 38 of each of the C's are joined but one of the coils is inverted with respect to the other such that the composite toroid 39 formed by the two cores 30 has parallel bases 40 and 42 which are co-planar with bases 32 and 34.

As shown in the illustration inversion of one of the two cores in an inverted position with reference to the other enables abutment of the C-shaped core sections such that the ends 38(*a*) of the legs are in juxtaposed relation minimizing any air gap which might otherwise occur. It will be further noted that this juncture of leg 38 occurs well within the field of the winding 46 forming an integral part of a coil. This juncture is contrasted to the juncture of the two conventional L sections wherein the junctions would fall outside the coil 46 allowing a deterioration in the uniformity of the field strength. Since the windings 46 may be wrapped around a form 44 which may serve as an insulator. the complicated steps necessary to insulate a solid toroidal core are avoided. Additionally, the coils may all be machine wound on the form 44 even, including heavy conductor windings.

We claim:

1. The method for making a C-shaped core with a trapezoidal cross section of magnetizable powdered material and with high permeability comprising:

A. arranging a C-shaped mold having ends and a cavity and said trapezoidal cross section having two parallel sides with one parallel side larger and the other parallel side smaller, said mold having the ends corresponding to the parallel sides of the trapezoid open and having a ram movable into the mold cavity through the larger open end and an ejector movable into the mold cavity through the smaller open end, with the larger open end facing upward and the smaller open end closed by positioning the ejector in the smaller opening but not extending substantially into the mold cavity, B. placing a predetermined amount of the magnetizable powdered material into the mold cavity, C. inserting the ram into the mold cavity with sufficient force to compress the powdered material and to bond it into an integral structure of uniform density, D. withdrawing the ram and inserting the ejector into the mold cavity with sufficient force to eject the resultant integral structure, whereby pressure on all portions of the nonparallel faces of the integral structure is released uniformly, and said integral structure expands uniformly in all directions.

2. The method of claim 1 wherein said powdered material is selected from the group consisting of:

A. nickel-iron base alloys containing at least 30%w nickel, and

B. iron-silicon-aluminum alloys containing at least 80%w iron, at least 8%w silicon, and at least 4%w aluminum.

3. The method of claim 1 wherein the ram is inserted into the mold cavity with sufficient force to exert a pressure of at least 80 tons per square inch on the powdered material.

4. The method of claim 1 wherein the ram is inserted into the mold cavity with sufficient force to compress the powdered material to a uniform density of at least $6.0 g/cm^3$.

* * * * *